US006191376B1

(12) United States Patent
Bartok

(10) Patent No.: US 6,191,376 B1
(45) Date of Patent: Feb. 20, 2001

(54) PUSHBUTTON SWITCH

(75) Inventor: Stephen Bartok, Rancho Palos Verdes, CA (US)

(73) Assignee: Judco Manufacturing, Inc., Habor City, CA (US)

( * ) Notice: Under 35 U.S.C. 154(b), the term of this patent shall be extended for 0 days.

(21) Appl. No.: 09/495,114

(22) Filed: Feb. 1, 2000

(51) Int. Cl.[7] ..... H01H 3/32; H01H 13/56
(52) U.S. Cl. ..... 200/529; 200/526; 200/528
(58) Field of Search ..... 200/520–537

(56) References Cited

U.S. PATENT DOCUMENTS

| | | | | |
|---|---|---|---|---|
| 3,694,603 | * | 9/1972 | Congelliere et al. | 200/526 |
| 4,055,736 | * | 10/1977 | Congelliere | 200/16 A |
| 4,175,222 | * | 11/1979 | Buttner | 200/528 |
| 4,308,440 | * | 12/1981 | Buttner | 200/303 |
| 4,317,015 | * | 2/1982 | Buttner et al. | 200/526 |
| 4,319,106 | * | 3/1982 | Armitage | 200/526 |
| 4,345,128 | * | 8/1982 | Buttner et al. | 200/526 |
| 4,906,808 | * | 3/1990 | Buttner et al. | 200/527 |
| 4,939,328 | * | 7/1990 | Smith | 200/528 |
| 5,132,499 | * | 7/1992 | Valenzona et al. | 200/526 |
| 5,226,529 | * | 7/1993 | Valenzona | 200/529 |

FOREIGN PATENT DOCUMENTS 1362299 9/1964 (FR) .

* cited by examiner

*Primary Examiner*—J. R. Scott
(74) *Attorney, Agent, or Firm*—Christie, Parker & Hale, LLP

(57) ABSTRACT

A pushbutton, momentary ON switch has a body including a barrel with longitudinally extending internal splines and ways between the splines. A plunger has radially extending lugs in the ways and is longitudinally movable in the barrel. A plurality of longitudinally extending camming teeth on the plunger engage a plurality of longitudinally extending camming teeth on a rotatable ratchet coaxial with the plunger. The ratchet is spring loaded against the plunger. The ratchet has radially extending dogs which fit into the ways when the plunger is retracted and come out of the ends of the ways when the plunger is advanced. A rotatable electrical contact cup connected to the ratchet and electrically connected to an external lead makes or breaks contact with a fixed electrical terminal in the body. The plunger teeth include a leading ramp face and a trailing ramp face wherein the leading ramp face extends a greater distance in the circumferential direction than the trailing ramp face. The asymmetrical teeth permit symmetrical rotation of the ratchet and electrical contacts. In this case, the contacts rotate approximately 22½° in each half of the stroke of the plunger, making contact upon depressing the plunger and breaking contact upon its retraction. Since the plunger teeth each having an apex offset from a centerline of the tooth, they advance the ratchet a sufficient distance that electrical contact between the fixed electrical terminal member and the rotatable electrical contact cup is made substantially simultaneously with a tactile and/or auditory signal from the switch as the plunger advances the ratchet.

20 Claims, 10 Drawing Sheets

17
6
5
4
30
31
40
41
45
46
107
50
55
105
103
88
75
77
126
83
94
95
104
96
86
79
89
76
127
100
99
54
114
113
97
115
98
128
101
63
65
8
78
80
62
84
75
61
117
72
66
116
81
118
90
129
87
71
2
70
85

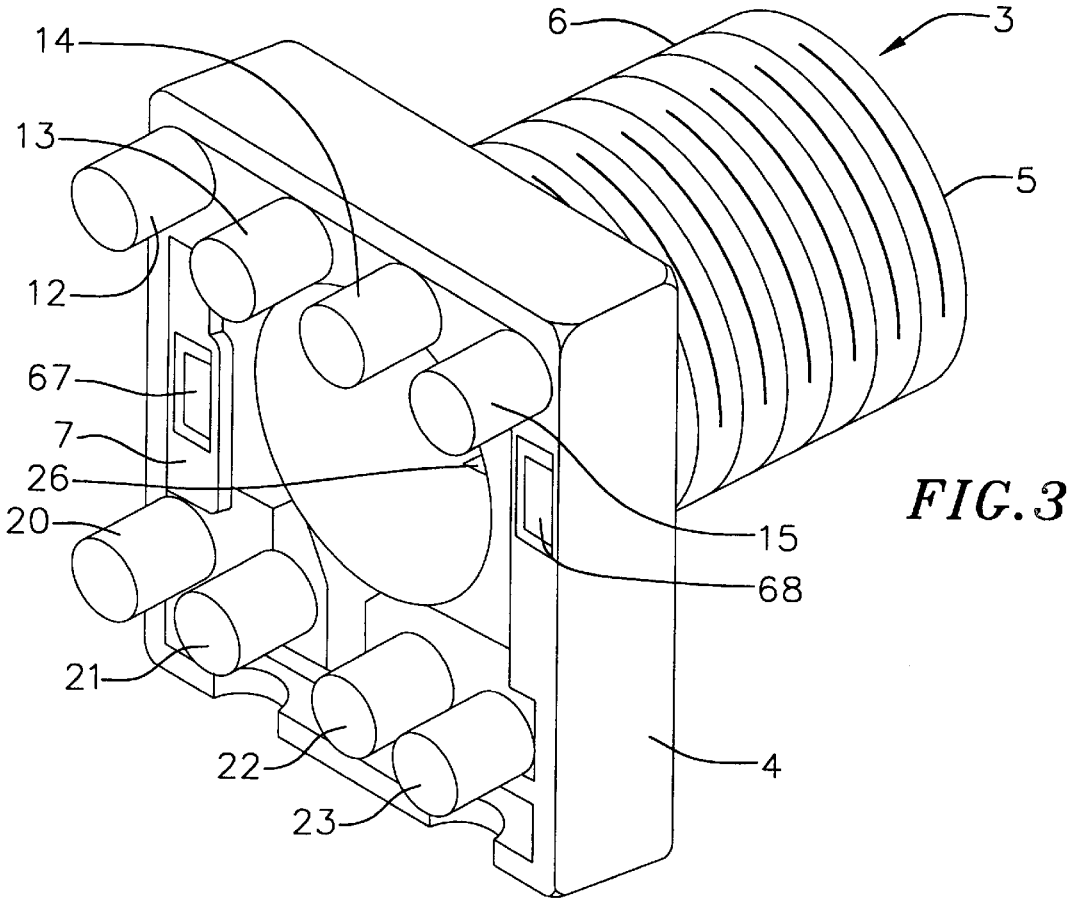
FIG. 3
FIG. 4
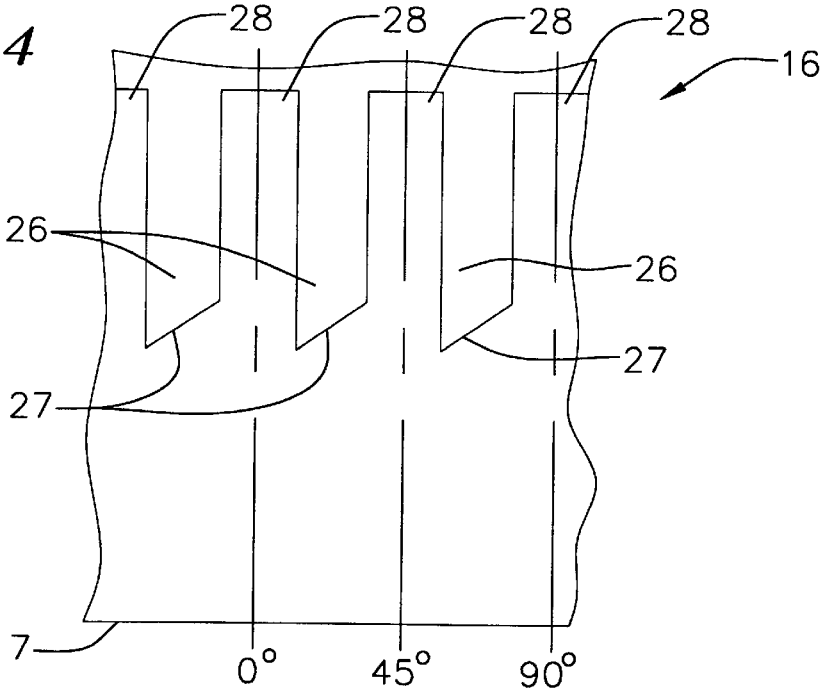

175
177
176
202
200
201
204
205
206

PUSHBUTTON SWITCH

BACKGROUND

The present invention relates to pushbutton switches for use in electrical circuits and in particular to pushbutton switches in which electrical contact is either made or broken substantially simultaneously with a tactile and/or auditory signal from the switch as the switch plunger advances. In one embodiment this may be a momentary ON switch in which electrical contact is made upon advancing the plunger and contact is broken when the plunger retracts.

Pushbutton switches are well known in the art and examples thereof may be found in U.S. Pat. Nos. 3,694,603, 4,055,736, 4,175,222, 4,319,106, 4,345,128, 4,906,808, 5,132,499 and 5,226,529, the disclosures of which are incorporated herein by reference. The foregoing patents disclose pushbutton switches adapted to sequentially open and close an electrical circuit or to sequentially switch a common lead between two alternate portions of a circuit. In addition to the switches shown in the above patents, other designs are known in the art, having a variety of configurations, adapted for similar function.

In prior pushbutton switches having a plunger which advances a rotatable ratchet by camming action, the ratchet advances part of a turn upon advance of the plunger and then, upon release of the plunger, electrical contact is made as the plunger retracts. Upon the next actuation of the switch, electrical contact is broken. Such a switch is shown, for example, in U.S. Pat. No. 5,226,529. Such a switch may be used for an ON-OFF light switch, for example.

It is desirable, however, for electrical contact to be made or broken simultaneously with advance of the ratchet so that the switch operator either hears an audible click or feels a change in pressure on the plunger (or both) as the state of contact is changed. This is particularly desirable in a momentary ON switch where electrical contact is made upon advancing the plunger so that the operator knows when contact is made, and can then release the plunger. Such switches find utility in modern automotive applications where the pushbutton switch provides a momentary signal to a circuit that initiates some action, rather than the action being caused by current through the pushbutton switch directly. A "low tech" example of such signals occurs in some household doorbell systems where chimes continue to play after a momentary push on the doorbell has been released.

SUMMARY OF THE INVENTION

In a presently preferred embodiment, the pushbutton switch comprises a body including a barrel with longitudinally extending internal splines and ways between the splines. A plunger has radially extending lugs in the ways and is longitudinally movable in the barrel. A plurality of longitudinally extending camming teeth on the plunger engage a plurality of longitudinally extending camming teeth on a rotatable ratchet coaxial with the plunger. The ratchet has radially extending dogs which fit into the ways when the plunger is retracted, and come out of the ends of the ways when the plunger is advanced. A rotatable electrical contact member connected to the ratchet stays connected to a common switch terminal and makes or breaks contact with one or more fixed electrical terminals in the switch. The plunger teeth include a leading ramp and a trailing ramp wherein the leading ramp extends a greater distance in the circumferential direction than the trailing ramp.

Since the plunger teeth each having an apex offset from a centerline of the tooth, they advance the ratchet a sufficient distance that electrical contact between the fixed electrical terminal member and the rotatable electrical contact member is made substantially simultaneously with a tactile and/or auditory signal from the switch as the plunger advances toward the ratchet.

BRIEF DESCRIPTION OF THE DRAWINGS

These and other features and advantages of this invention are more fully set forth in the following description of the presently preferred embodiments when considered in connection with the accompanying drawings in which:

FIG. 3 is a perspective view of a body portion of the switch;

FIG. 4 is a broken away portion of an interior wall of a barrel forming part of the body depicted in FIG. 3, the wall shown flattened out to illustrate splines located therein;

DETAILED DESCRIPTION

Figure 1:
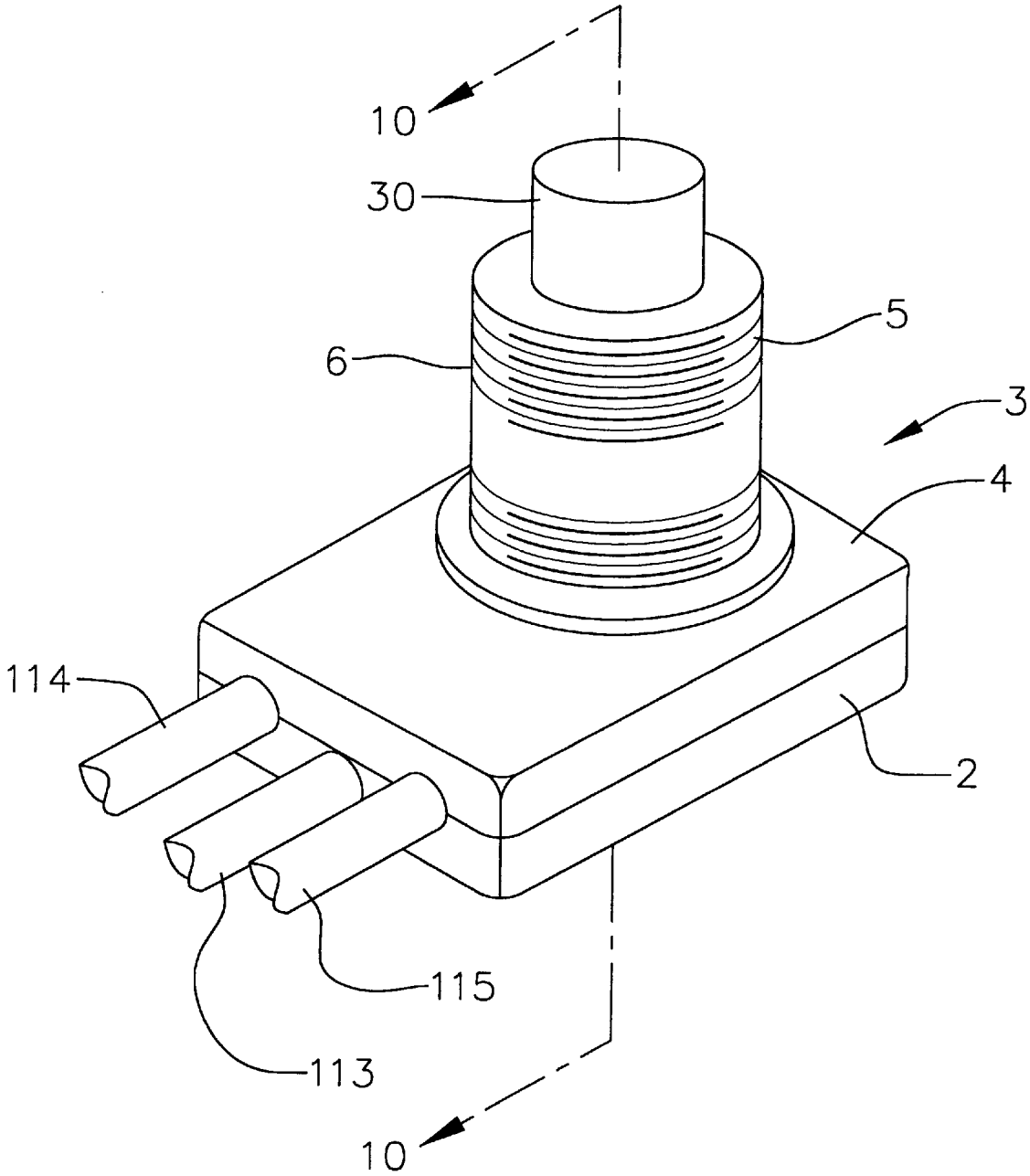
FIG. 1 is a perspective view of a presently preferred embodiment of momentary ON pushbutton switch.
Figure 2:
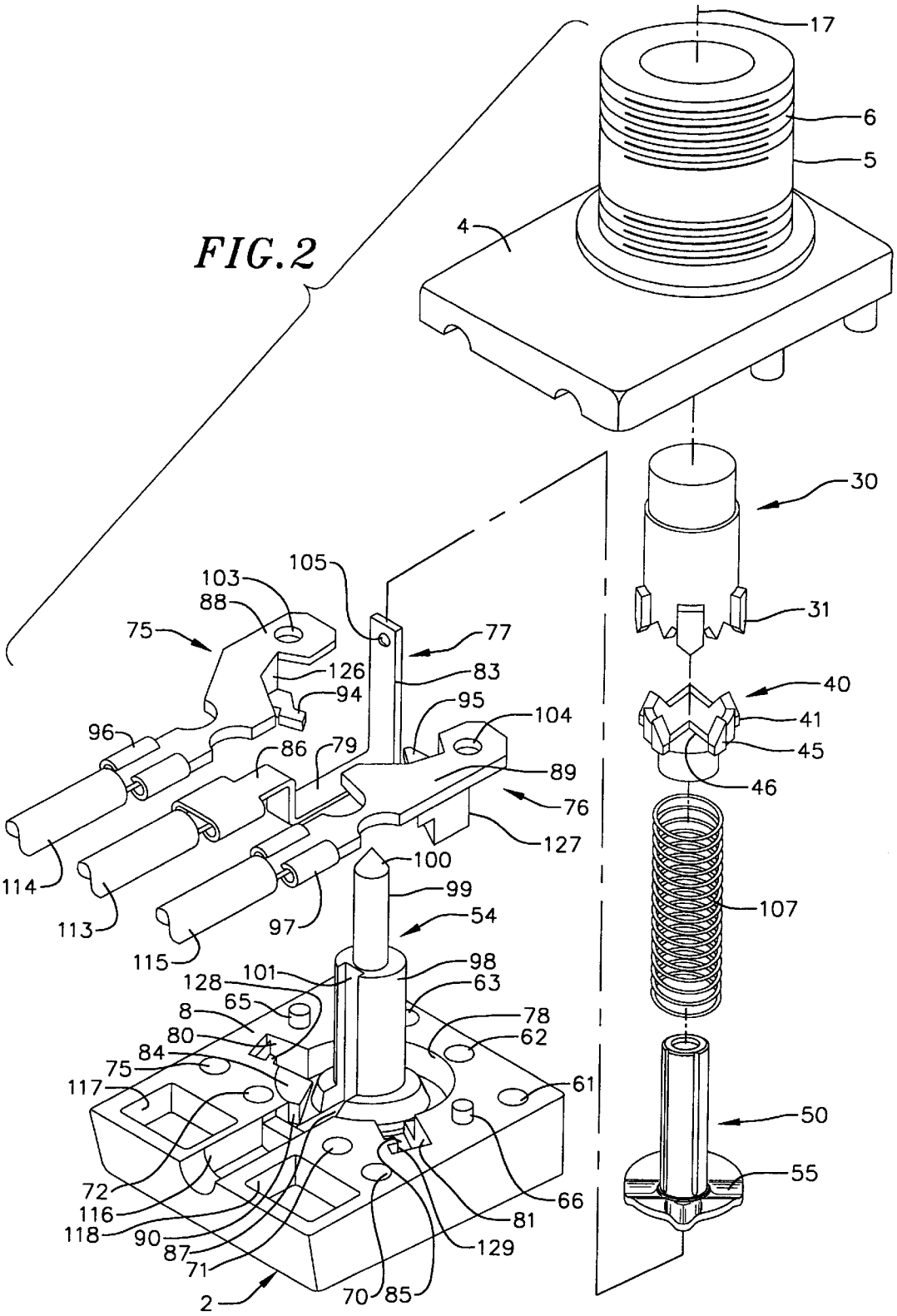
FIG. 2 is an exploded, perspective view of the switch of FIG. 1.

Referring to FIGS. 1 and 2, there are shown perspective and exploded views of a preferred embodiment of the pushbutton switch. The switch includes separable housing portions comprising a cover 2 and a body 3. A plunger 30, ratchet 40 and contact cup 50 are contained within the body.

The body has a planar portion 4 and a barrel 5. The barrel 5 is open at its ends and may or may not have threads 6 on its exterior surface. The planar portion 4 of the body is provided with a mating surface 7. The mating surface 7 has a plurality of spaced pin members, with eight pin members 12–15 and 20–23 being preferably used (FIG. 3). The pin members are disposed in two substantially parallel rows on opposite sides of the barrel and are engagable with recesses correspondingly located in a conforming surface 8 of the cover 2.

A broken away and flattened portion of the interior wall 16 of the barrel is shown in FIG. 4. Splines 26 inside the barrel have spaced apart parallel walls extending longitudinally parallel to the axis 17 of the barrel. Ramps 27 form the end of the splines 26 closest to the mating surface 7. The ramps have an angle of about 45° from the sides of the splines. The splines are formed by molding the barrel to have a thicker wall in the region of the splines than in the remainder of the barrel. The thinner wall portions between adjacent splines comprise longitudinally extending ways 28. In an exemplary embodiment there are eight splines equally spaced 45° apart, hence eight ways between adjacent splines.

Figure 5:
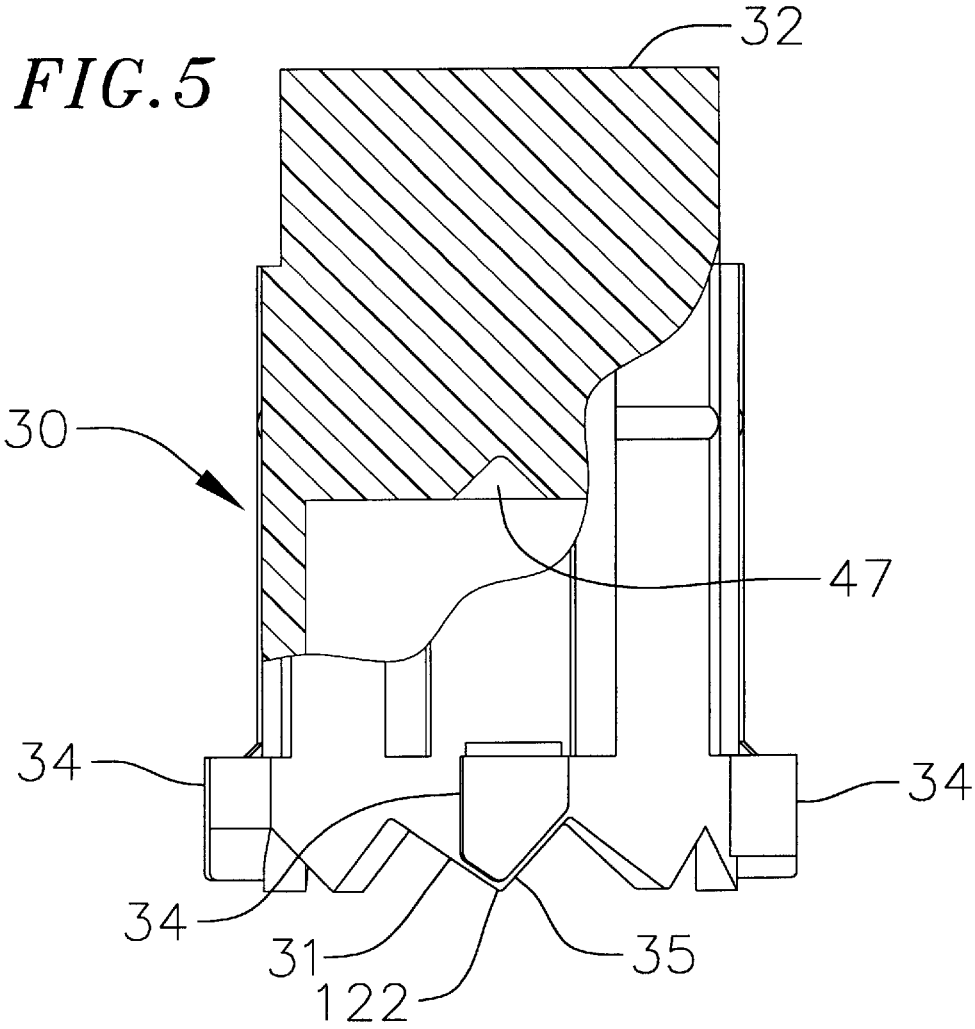
FIG. 5 is a side view, partly cut away in cross section, of a plunger adapted for movement within the body portion of the switch.
Figure 12:
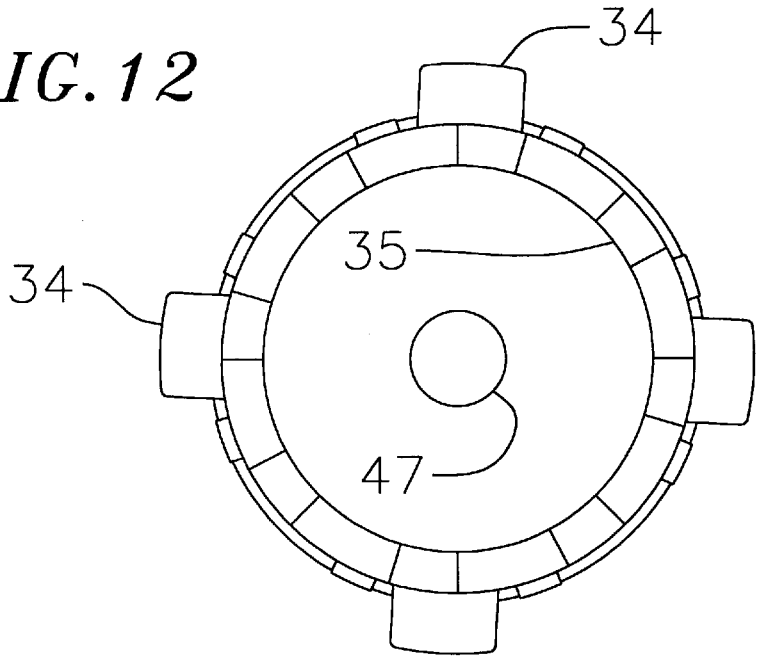
FIG. 12 is an end view of the end of the plunger with camming teeth.

The plunger 30 is shown in FIGS. 5 and 12. The plunger is adapted for axial sliding movement within the barrel. The plunger is tubular in form, having an open end portion 31 and a closed end portion 32. When inserted in the body, the closed end portion 32 projects out of the barrel providing a primary actuating button for operation of the switch. (When installed in service, a cover or wider button may be added over the end of the plunger.) The open end portion 31 has a plurality of circumferentially spaced lugs 34, with four lugs being employed in this preferred embodiment. The lugs are spaced 90° apart projecting generally radially outwardly. When the plunger is within the barrel, the lugs ride in the ways 28 and engage the splines 26. The length of the splines is sufficient to maintain engagement with the lugs during the full actuation of the switch, preventing angular rotation of the plunger 30 relative to the barrel.

The open end portion additionally comprises a plurality of evenly spaced camming teeth 35. The camming teeth form a sawtooth annular ring on the end of the plunger. This preferred embodiment utilizes eight camming teeth 35, four of which include end portions of the lugs. The camming teeth are asymmetrical as described below after other parts of the switch are described.

Figure 6:
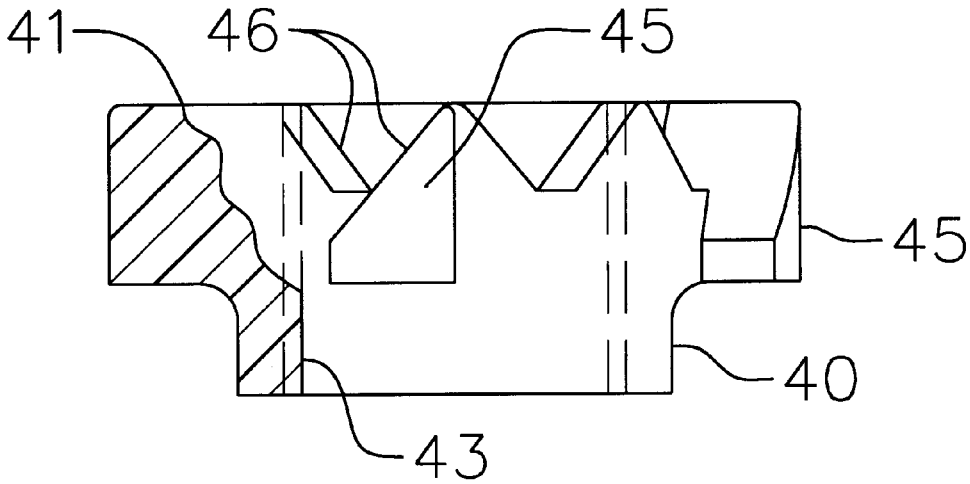
FIG. 6 is a side view, partly cut away in cross section of a ratchet adapted for working with the plunger shown in FIG. 5.
Figure 7:
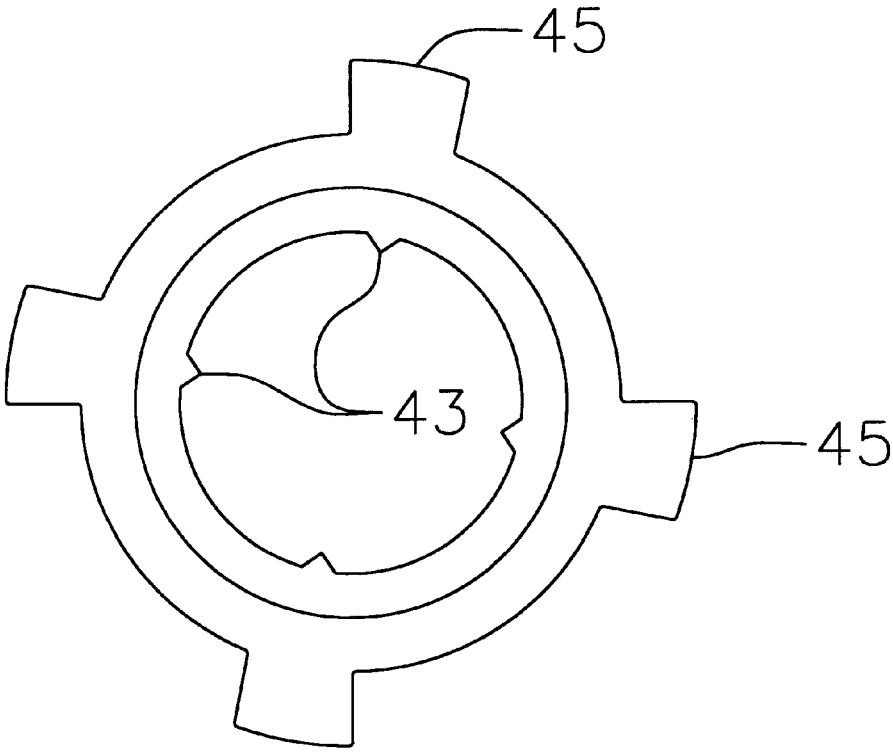
FIG. 7 is an end view of the ratchet of FIG. 6.

The ratchet mechanism of the switch comprises the spline ramps 27 and the ways 28 of the barrel, the lugs 34 on the plunger and 45 on the ratchet and camming teeth 35 of the plunger and 46 on ratchet 40. Referring to FIGS. 6 and 7, the ratchet 40 has a generally cylindrical lower portion with a cylindrical longitudinal passage. A plurality of elongated longitudinal V-shaped ribs 43 are formed in the interior wall of the ratchet, four ribs being presently preferred, spaced 90° apart. The upper end of the ratchet has a plurality of circumferentially spaced dogs 45, with four dogs 45 being preferred in this embodiment to correspond to half the number of ways in the barrel. The dogs 45 are spaced 90° apart around the ratchet 40, projecting radially outwardly therefrom. When the ratchet is inserted into the barrel, the dogs first engage the ramps 27 on the ends of the splines and then enter the ways 28. The splines 26 are of a length to permit disengagement from the dogs 45 during actuation of the switch, permitting angular rotation of the ratchet relative to the barrel and the plunger.

The upper end portion 41 of the ratchet has a plurality of evenly spaced camming teeth 46, distributed around the exterior surface of the ratchet. The ratchet camming teeth face towards and are adapted to mate with the plunger camming teeth 35. The camming teeth 35 in this embodiment of the ratchet are symmetrical, and their exact shape is not believed to be important, as long as they allow the ratchet motion to follow the plunger teeth.

Figure 8:
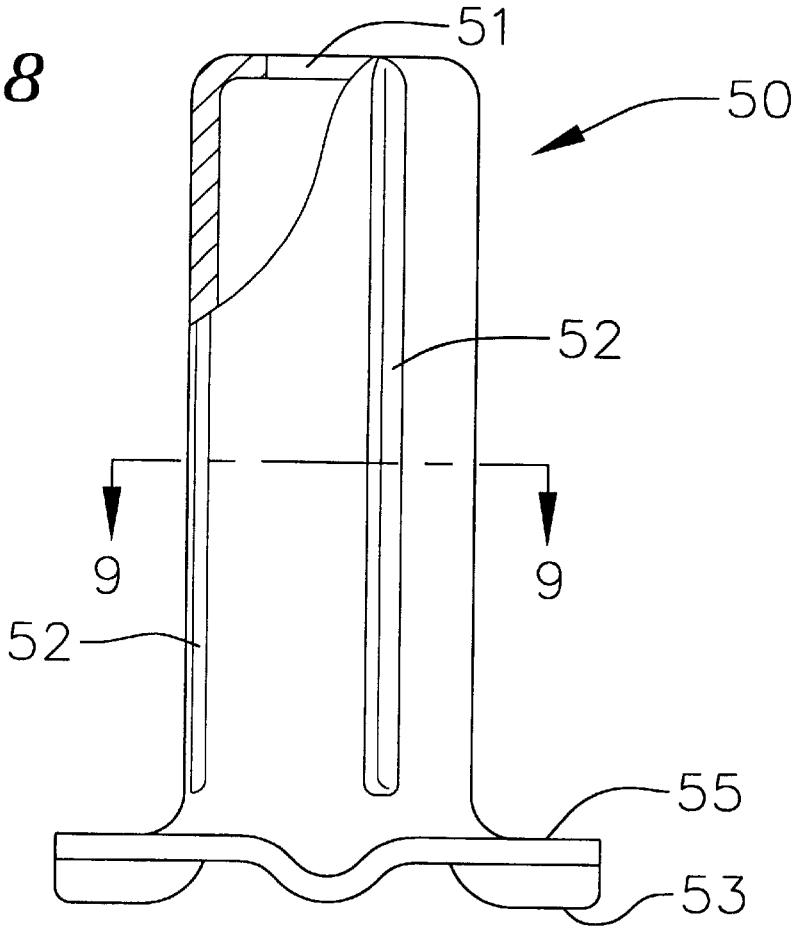
FIG. 8 is a side view partly broken away of a contact cup, taken along its long axis, the cup adapted for insertion within the ratchet shown in FIGS. 6 and 7.
Figure 9:
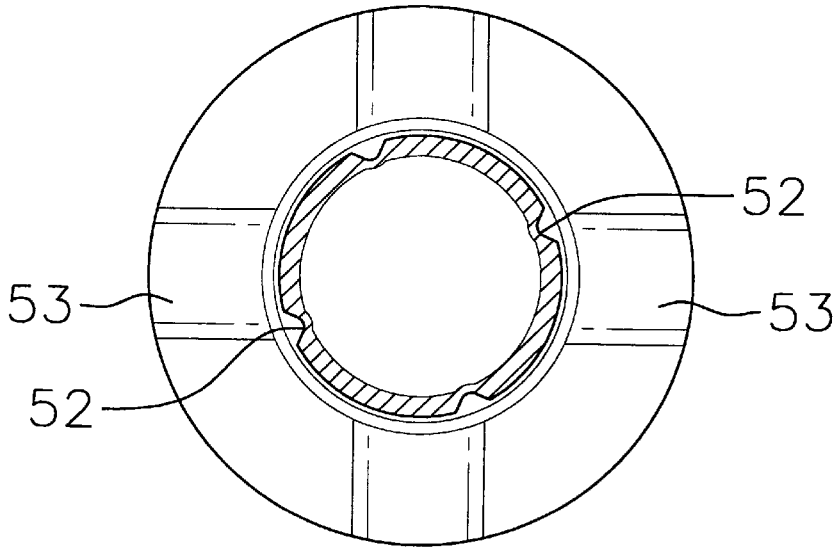
FIG. 9 is an transverse cross section of the contact cup of FIG. 8.

FIGS. 8 and 9 illustrate the contact cup 50. The contact cup is made of a conductive material such as 70/30 cartridge brass, phosphor bronze or the like, and is adapted for rotation to make and break electrical connections with a left terminal 75 and a right terminal 76 (FIG. 2) as described below. The contact cup is generally tubular in shape having one end open and the other end partially closed. The partially open end has a circular opening 51 which provides a bearing surface for a central post stud 54. The central post stud extends from the cover 2 into the barrel along the barrel axis 17 (FIG. 2). The open end of the contact cup has a circular flange 55 extending radially outward from the circumference thereof. Four equally spaced areas on the flange are formed downwardly in a curved bulge referred to as contact tabs 53. In the presently preferred embodiment, four generally radially extending tabs are evenly spaced around the open end. During switch operation, the contact tabs engage in alternate wiping contact with a portion of the left and right terminals 75, 76 (FIG. 2). The contact tabs have curved edges on the bulges to prevent galling the terminals when making such contact with the terminals.

The contact cup is additionally provided with a plurality of elongated longitudinal V-shaped grooves 52 on its external surface. The grooves begin at the partially closed end and extend along the body of the cup nearly the full distance to the open end. The partially closed end of the cup and the portion of its length containing the grooves 52 are inserted and keyed with a sliding fit into the ratchet 40. The grooves are of the same number and mate with the ribs 43 within the ratchet. The mating of the ribs and grooves causes the ratchet and contact cup to rotate as a single unit when the switch is actuated. The ratchet is free to slide longitudinally along the contact cup. The ribs and grooves are aligned such that the contact tabs 53 are displaced approximately 22.5° from the ratchet dogs 45.

Figure 11:
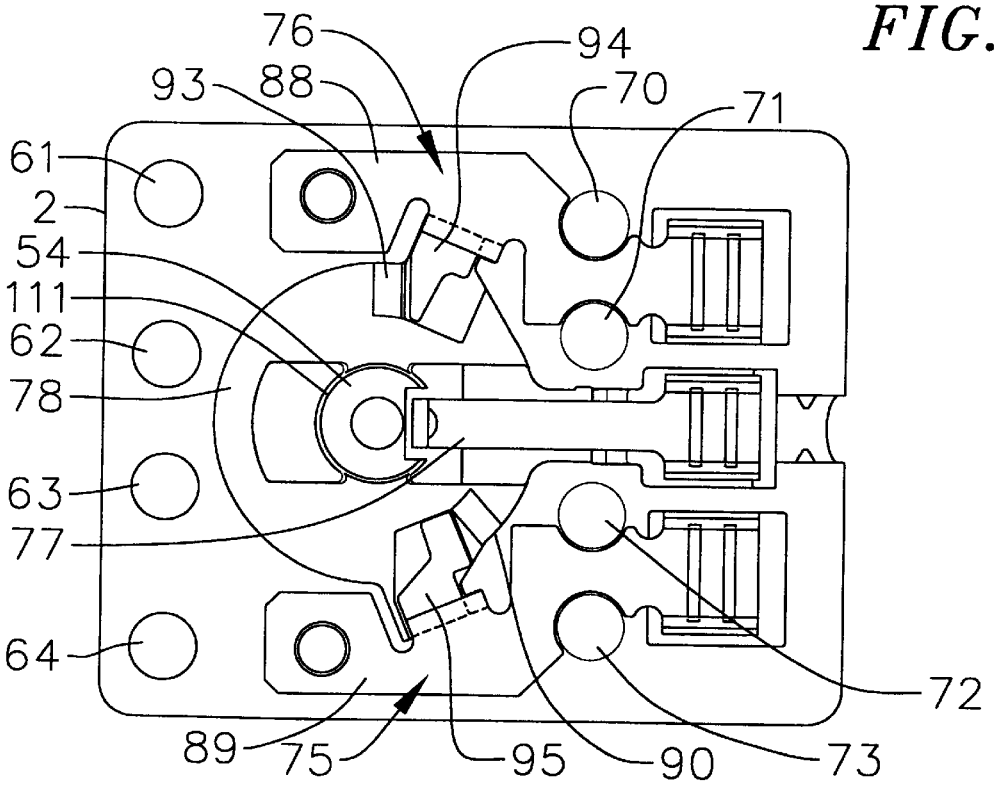
FIG. 11 is a top plan view of the cover portion of the switch.

The switch cover 2 is shown in best detail in FIGS. 2 and 11. The cover is provided with a plurality of recesses in its conforming surface 8. Eight holes 61–64 and 70–73 are in two substantially parallel rows on opposite sides of the central post stud 54. The holes mate with pin members 12–15 and 20–23 located in the mating surface 7 of the switch body (FIG. 3) when the cover and body are assembled together. The cover and the body are preferably held together by means of an interference fit between the holes and the pin members. An approximately circular recess or cavity 78 extends into the cover with its center aligned with the barrel axis 17. The central post stud 54 extends perpendicularly along the center of this recess or cavity. Two terminal recesses 80, 81 open into the circular recess or cavity 78.

The bottom of the circular recess or cavity is planar and has a center channel 87, two terminal pockets or pads 84, 85, two main camming ramps 90, 93 located thereon. The terminal recesses 80, 81 are located approximately 67.5° on either side of a center channel 82. The ramps slope upward from the bottom of the circular recess or cavity 78 at an angle of about 14° in a clockwise direction when viewed from above. One of the ramps 90, 93 is located before each of the terminal pockets 84, 85, moving in a clockwise direction as viewed from above. The ramps 90, 93 provide a smooth transition from the bottom of the circular recess or cavity 78 to a height at the level that of the terminal contact surfaces.

Two terminal locating posts 65, 66 extend away from the conforming surface 8 of the cover, the posts being preferably located between the parallel rows of holes. Two recesses 67, 68 (FIG. 3) are located in the mating surface 7 of the body to receive the locating posts.

The left and right terminals 75, 76 each include a mounting portion 88, 89, a planar contact portion 94, 95, a crimped end portion 96, 97 and a locating hole 103, 104. The terminals are mounted on the cover and held in place by the mating surface of the body, the mating surface 7 being recessed to conform to the shape of the terminals. The terminals are secured in position by the locating posts 65, 66 which pass through the locating holes 103, 104. The terminals are additionally secured in position by adjacent vertical members 126, 127 of the contact portions 94, 95 which seat in the terminal recesses 80, 81. The vertical members 126, 127 are held position-captive by ribs 128, 129 which are integrally molded with the cover. When seated, the contact portions 94, 95 are located in a plane slightly (e.g. 0.08 mm) above the ramp tops, and are parallel to the bottom of the circular recess or cavity 78.

The central post stud 54 comprises a lower center post 98, and an upper guide post 99. The lower center post has a channel relief 101. The upper guide post is provided with a conical tip 100 which mates with a conical recess 47 in the interior of the plunger (FIG. 5). The conical tip acts as a stop when the plunger 30 is depressed all the way to the bottom. This prevents deformation damage to the contact cup or terminals. Engagement of the conical tip with the mating conical recess in the interior of the plunger also prevents the upper guide post from deflecting to one side when the plunger is depressed all the way to the bottom.

A common terminal 77 is additionally located on the cover 2. The common terminal 77 has a substantially U-shaped portion 79, a right-angled finger portion 83 and a crimped end portion 86. The end of the finger portion is provided with a raised bulge 105, which at all times maintains electrical contact with the inside of the contact cup 50. The U-shaped portion 79 seats in the center channel 87 while the right-angled portion 83 is positioned in the channel relief 101.

The crimped end portions 86, 96 and 97 of the terminals are attachable to conventional electrical conductors 113, 114 and 115, respectively, to connect the switch to a common lead and two portions of an external electrical circuit. Recesses 116, 117 and 118 are located in the conforming surface 8 of the cover to provide clearance for the crimped end portions 86, 96 and 97.

Figure 10:
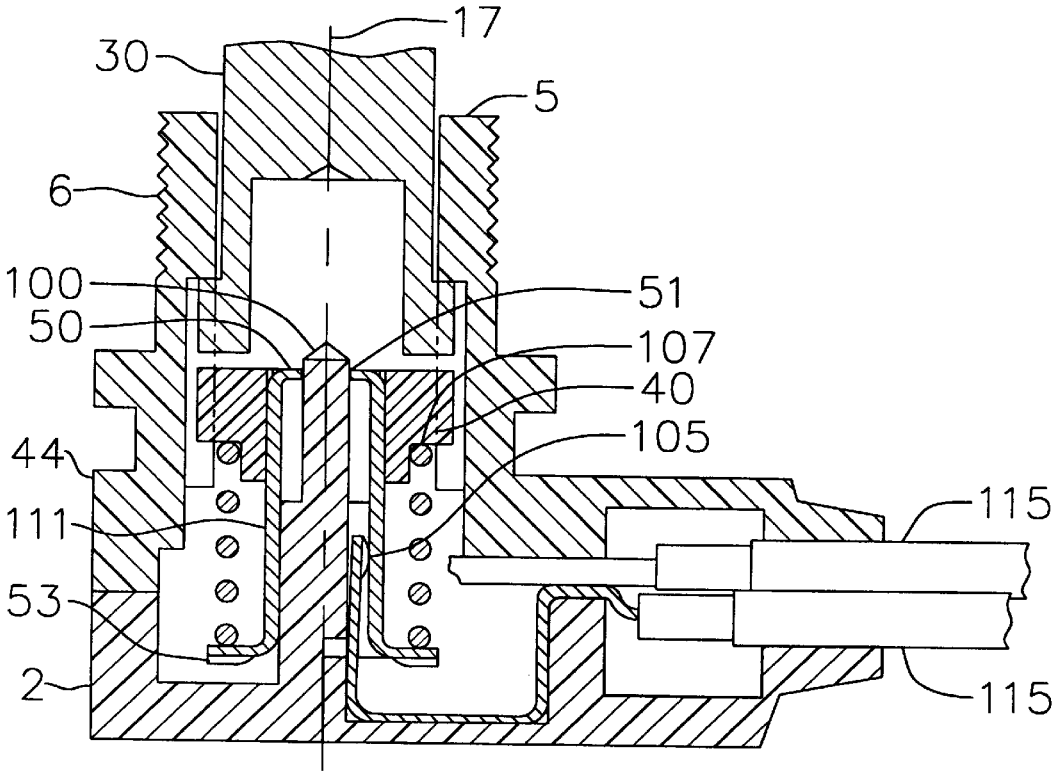
FIG. 10 is a sectional view of the switch shown in FIG. 1 taken along line 10—10.

FIG. 10 shows a sectional view of the switch taken along line 10—10 of FIG. 1. When assembled, the plunger 30 is inserted in the barrel 5, the ratchet 40 is positioned opposite and coaxial with the plunger, the contact cup 50 is inserted through the ratchet 40, and the cup opening 51 is positioned so that the contact tip 100 extends therethrough. A helical spring 107 is disposed around the outside of the contact cup and seats between the radial flange 55 and the end portion of the ratchet. The spring 107 provides a continual force against the flange, biasing one of the tabs 53 toward one of the left or right terminals 75, 76. The spring also biases the ratchet towards the plunger for engaging the ratchet teeth with the plunger teeth and drives the rotary motion of the ratchet and cup.

The left and right contact portions 95, 94 extend generally radially toward the axis 17 of the barrel in directions that are 135° apart. The four tabs on the contact cup are 90° apart. Thus, one of the tabs can be in contact with one of the contact portions and the other three tabs are necessarily out of contact with the other contact portion. With such contact between the cup and a contact portion, the switch is in an ON position with an electrical connection path between one external electrical conductor 114 or 115 and a central conductor 113. The contact portions are sufficiently small that when the contact cup (and the ratchet) has rotated 22½° from a position where one of the tabs is in contact with a contact portion, none of the tabs are in electrical contact and the switch is in an OFF position. Upon rotation an additional 22½° another tab comes into electrical contact with the other of the contact portions and the switch is again in an ON position.

The camming teeth 35 on the plunger are asymmetrical to provide approximately 22½° rotation of the ratchet and cup upon advance of the plunger toward the ratchet. Another 22½° rotation of the ratchet and cup upon retraction of the plunger, e.g. when finger pressure is released occurs due to engagement of the ratchet lugs against the angled faces on the body splines. As seen in the schematic illustration of FIG. 16, each camming tooth has a longer leading face 120 and a shorter trailing face 121. The leading face extends 280 circumferentially around the end of the plunger and the trailing face extends 17° around the end of the plunger. These angles are for one embodiment and may be varied; for example the angles may be 30° and 15°, respectively. The sum of the angles is 45° in an embodiment with four contact tabs.

Thus, the apex 122 between the leading and trailing faces is offset from the centerline of the tooth, i.e., offset from a midpoint between the valleys between adjacent teeth. Furthermore, the lugs on the plunger are placed so that when lugs are in the ways between the body splines, an edge between a spline and way is radially aligned with a location 124 on the leading ramp spaced apart from the apex. To obtain the same rotation (about 22½°) upon both advance and retraction of the plunger, the circumferential distance, shown as "A" in FIG. 16A, between the bottom of the valley 123 between teeth) and the location 124 is equal to the circumferential distance, shown as "B" in FIG. 16A, between the location 124 and the bottom of the valley 125 at the trailing ramp.

Figures 16A, 16B, 16C:
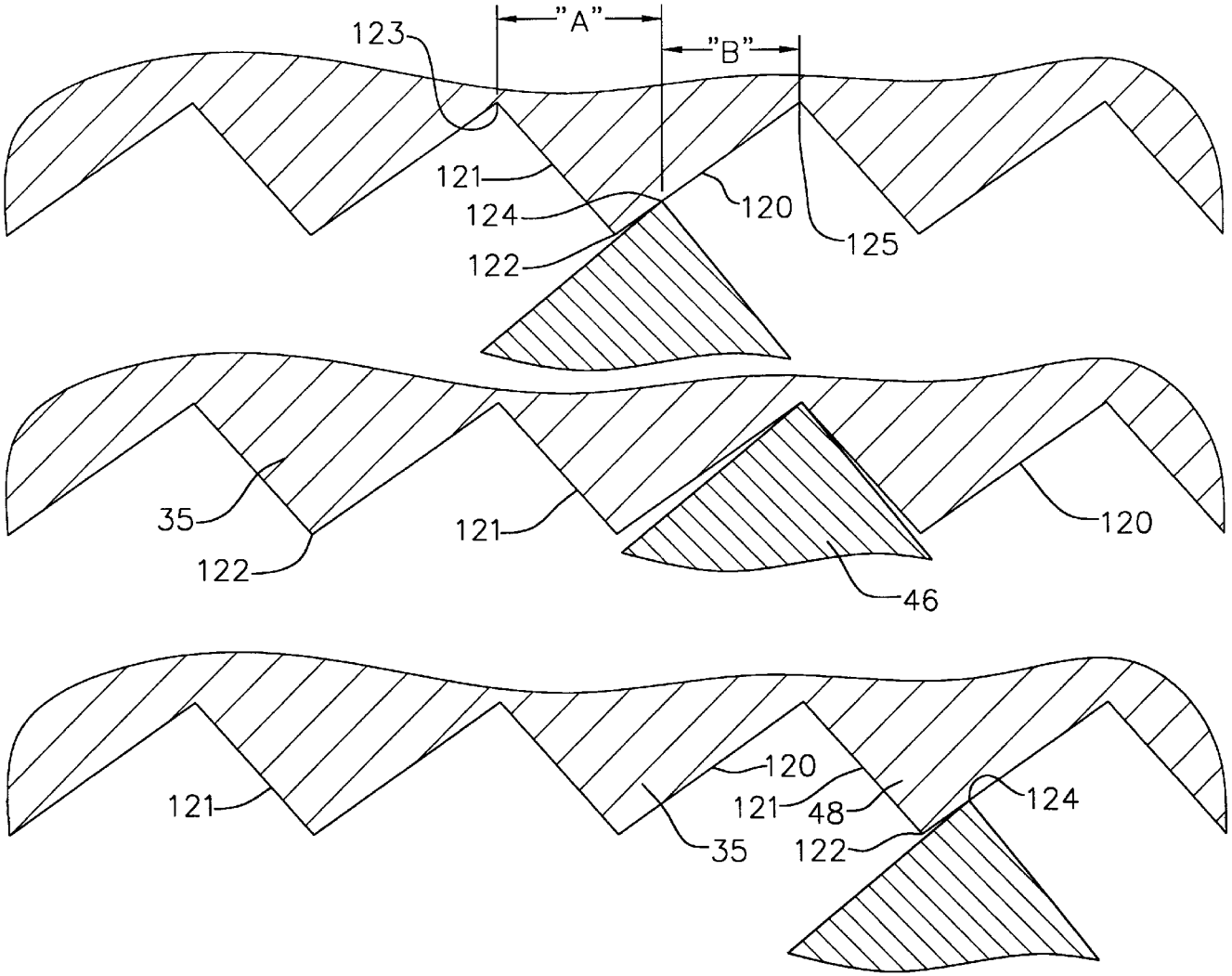
FIGS. 16*a*–16*c* are schematic illustrations of engagement of plunger and ratchet teeth.

The splines and ratchet dogs are arranged so that upon retraction of the plunger, the ratchet comes to a rotational position with the apex of the ratchet teeth at a location on the leading face of the plunger teeth between the apex of each plunger tooth and the valley between that plunger tooth and the adjacent plunger tooth (FIG. 16A). This is a stable location for the apex of the ratchet teeth since the ratchet cannot rotate any further due to engagement of the ratchet dogs with the splines. In addition to the arrangements described and illustrated herein, the angular relations of the engaging ratchet and plunger teeth, plunger lugs, ratchet dogs and splines can be adjusted to provide this result on asymmetrical plunger teeth.

When the plunger of the switch is not depressed, all of the contact tabs 53 are located circumferentially away from (not in contact with) either of the planar contact portions 94, 95 and the switch is OFF. The spring 107 is biasing the ratchet 40 towards the plunger 30 as far as it will go, engaging the ratchet dogs 45 within the ways 28. The ratchet also transfers the spring force to the plunger 30 and has moved the plunger into the barrel 5 to its fullest extent, the plunger lugs 34 engaging the walls of the splines adjacent to the ways 28. The plunger camming teeth 35 and the ratchet camming teeth 46 are in partial engagement, being about 22½° out of full alignment, apex to valley.

Switch actuation begins with a downstroke of the plunger 30. During the beginning and the middle of the downstroke, the plunger and the ratchet move down the barrel, compressing the spring. Near the end of the downstroke, the ratchet dogs 45 travel beyond the end of the splines 26 permitting partial rotation of the ratchet 40. The force of the primary spring 107 acting against the force of the downstroke causes the ratchet to rotate until the plunger camming teeth 35 and the ratchet camming teeth 46 are fully engaged. The amount of this rotation of the ratchet is 22½° clockwise. The rotation of the ratchet is transferred to the contact cup 50 causing rotation of the contact tabs 53 about the lower center post 98. The terminal planar contact portions 94, 95 are located so that this amount of rotation by the tabs brings one of the tabs into electrical contact with the contact portion 94, 95 of one of the terminals. Thus, the switch is ON.

At the end of a downstroke to at least the point where the ratchet clicks into full engagement of the teeth, release of pressure on the plunger initiates an upstroke, permitting the spring 107 to return the ratchet and the plunger to their initial longitudinal positions. During the upstroke of the plunger, the ratchet dogs 45, now rotated 22½° from their initial position, are no longer aligned with the ways 28 from which they emerged. As the ratchet moves up, the ratchet dogs engage the spline ramps 27 and move along their length clockwise. The clockwise movement of the dogs rotates the ratchet and the contact cup another 22½°. Each ratchet dog enters the way 28 clockwise from that from which it emerged, moving up its length as far as it can go. In the final position of the ratchet, the ratchet camming teeth are partially engaged with the plunger camming teeth, just as they were before the downstroke.

This action can be represented in the illustration of FIG. 16. In this schematic illustration, a row of plunger teeth are illustrated above one ratchet tooth 46. Each plunger tooth has a longer leading face 120, shorter trailing face 121 and apex 122. It is easier to explain the action by starting with the switch in its OFF position with the plunger retracted. Initially, as illustrated in part A of FIG. 16, when the plunger is retracted, the ratchet tooth (representative of all the ratchet teeth which have been left off of FIG. 16 for clarity) has its apex at a location 124 on the long face of the plunger. It is stable in that position since the lugs on the ratchet engage the splines in the body and the ratchet cannot rotate any further.

As the plunger is depressed, the ratchet is also pushed downwardly against the spring. When the ratchet passes the ends of the splines, it is free to rotate and the sloping ramp of the leading face causes it to rotate to a position with the apex of the ratchet tooth in the valley between adjacent plunger teeth as seen in part B of FIG. 16. In other words, the teeth on the ratchet and plunger are fully engaged even though the teeth do not have the same angles on the surfaces. As previously described, this brings a tab into electrical contact with a terminal and the switch is in its ON position.

Equal angles on the surfaces of the teeth of the plunger and ratchet are not necessary. For example in the illustrated embodiment, the longer leading face 120 has an angle of 35° from a plane normal to the axis of the plunger and the shorter leading face 121 has an angle of 42°. The symmetrical ratchet teeth have an included tip or apex angle of 90° and each face of the tooth has an angle of 45° to a plane normal to the axis.

When the plunger retracts, the ratchet follows it upwardly as driven by the spring. When the ratchet dogs encounter the ramps on the ends of the splines, the ratchet cannot continue to follow the plunger in the same rotational orientation. Instead it is caused by force of the spring and engagement of the lugs and ramps to rotate. This rotation continues until the lugs can enter the next way between splines and the ratchet teeth move back into engagement with teeth on the plunger. The rotation of the ratchet is limited by the splines, however, and it comes to rest with the apex of a ratchet tooth at a location 124 on the leading ramp face of the next plunger tooth as illustrated in part C of FIG. 16.

The asymmetrical teeth on the plunger and other parts of the assembly are positioned so that the location on the leading face where the apex of the ratchet tooth comes to rest is equidistant from each valley at the ends of that plunger tooth. In other words, the location 124 is about 22½° from the valley at the end of the leading face and about 22½° from the valley at the start of the previous trailing face. This can be accomplished with any number of angular relationships between the lugs, dogs, camming teeth and terminal contacts. Key, however, is use of asymmetrical plunger teeth to control ratchet advance. Such action is infeasible with symmetrical teeth because of instability. With symmetrical teeth there can be asymmetrical rotation, i.e., rotation through different angles in the two parts (advancing and retracting) of the stroke. With asymmetrical teeth on the other hand, there can be symmetrical rotation in the two parts of each stroke.

The angular motion of the ratchet of 22½° is transferred to the tabs 53 on the cup. This rotation moves the tab on the terminal planar contact portion, off of the contact and the switch is now OFF. The angle of rotation is not enough to bring another tab into contact with the other terminal contact portion, since the two contact portions are, in effect, 45° apart. That would occur upon the next downstroke of the plunger.

Successive plunger strokes results in a tab contacting alternately the left and right terminal planar contact portions 94, 95, completing a circuit through the switch between the common terminal 77 and alternately the left and right terminals 75, 76. For a momentary ON switch, the left and right terminals are electrically connected together.

Thus, the switch is normally in its OFF position when the plunger is retracted. The ratchet teeth are not aligned with the plunger teeth since rotation of the ratchet is inhibited by engagement of its lugs with the splines. Upon depressing the plunger, the ratchet moves downwardly and when its lugs reach the lower end of the splines, it clicks 22½° to a rotational position where the ratchet teeth are aligned and in full engagement with the plunger teeth. This is a momentary ON position, since as soon as the plunger moves upwardly, the ramps on the ends of the splines cause an additional 22½° increment of rotation to take the switch to its OFF position again.

The way the plunger lugs, ratchet dogs, splines, end ramps on the splines and teeth on the plunger and ratchet interact to cause rotation of the ratchet upon depressing the plunger is described generally in U.S. Pat. No. 5,132,499, particularly with reference to FIGS. 5 to 12. The teeth on the plunger in that prior switch are symmetrical instead of asymmetrical as in the presently described switch, so the prior switch does not have a stable location where the apex of a ratchet tooth is stable on a face of a plunger tooth. The patent may be referred to, however, for another description of the general way that a ratchet type pushbutton switch operates.

Although described with four electrical contact tabs, four ratchet dogs, eight ratchet teeth, eight plunger teeth, four plunger lugs and eight splines, other numbers may be employed in other embodiments of pushbutton switch. The number of teeth on the plunger and ratchet is 360°/x where x is the circumferential angle of one full tooth (in this case x=45° and the number of teeth n is eight). For a momentary ON switch, the number of splines in the body is also n. The number of tabs is n/2 and the terminal contact portions are, in effect, spaced apart by an angle x, but displaced x/2 from the position of the tabs when the ratchet dogs are in ways in the body so that the switch moves from OFF to ON to OFF in one complete stroke of the plunger. In other embodiments, the number of teeth n may be three or five, for example, when greater or less angular rotation is desired for each depression of the plunger. The angles and numbers of splines, etc., change commensurately.

If one desires a switch with a cycle of ON upon one stroke of the plunger and OFF on the next stroke, the number of splines is made equal to the number of tabs and the terminal contact portions are located accordingly. A similar arrangement can be used where successive strokes of the plunger alternate contact between the left and right terminals.

In any of these arrangements, the asymmetrical leading and trailing ramp surfaces on the plunger teeth can be used to cause initial rotation of the ratchet and cup when the ratchet dogs come out of the ways to make or break an electrical contact simultaneously with the audible click of the ratchet and the slight change in resistance to moving the plunger as the teeth click into full engagement.

By lifting the tabs 53 near the plane of the terminal planar contact portions 94, 95 during each switch actuation, the ramps 90, 93 prevent the tabs from impacting the terminal contacts' side and top connecting edges. This prevents undesirable tab and contact wear. The height by which the ramps lift the tabs above the plane of the planar contact portions however, is not critical. Therefore, a precision molding process with respect to the ramp and terminal platform heights is not required, permitting the switch to be more economically manufactured.

Figure 13:
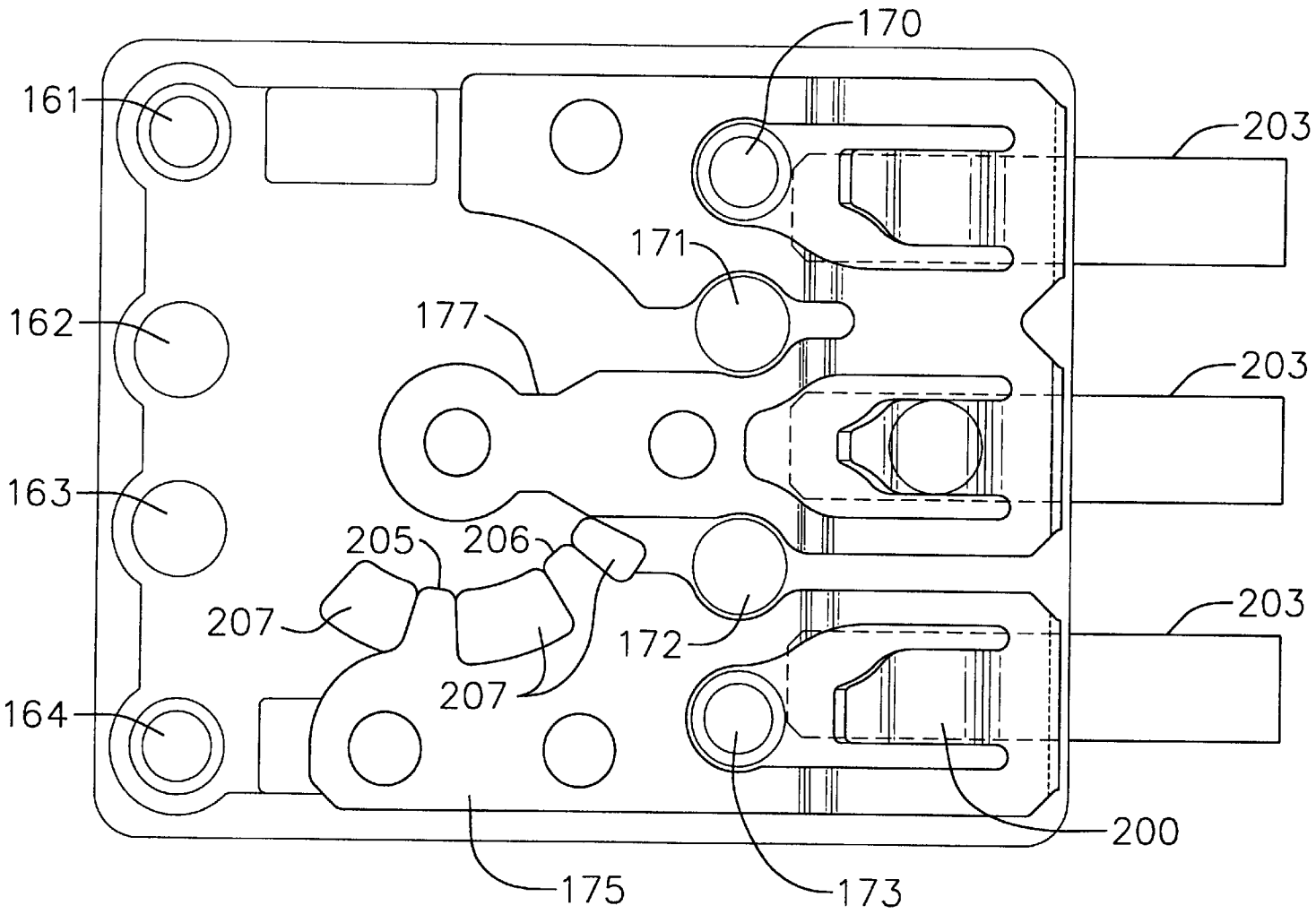
FIG. 13 is a top plan view of the cover portion and electrical contact terminals of a second embodiment of pushbutton switch.
Figures 14, 15:
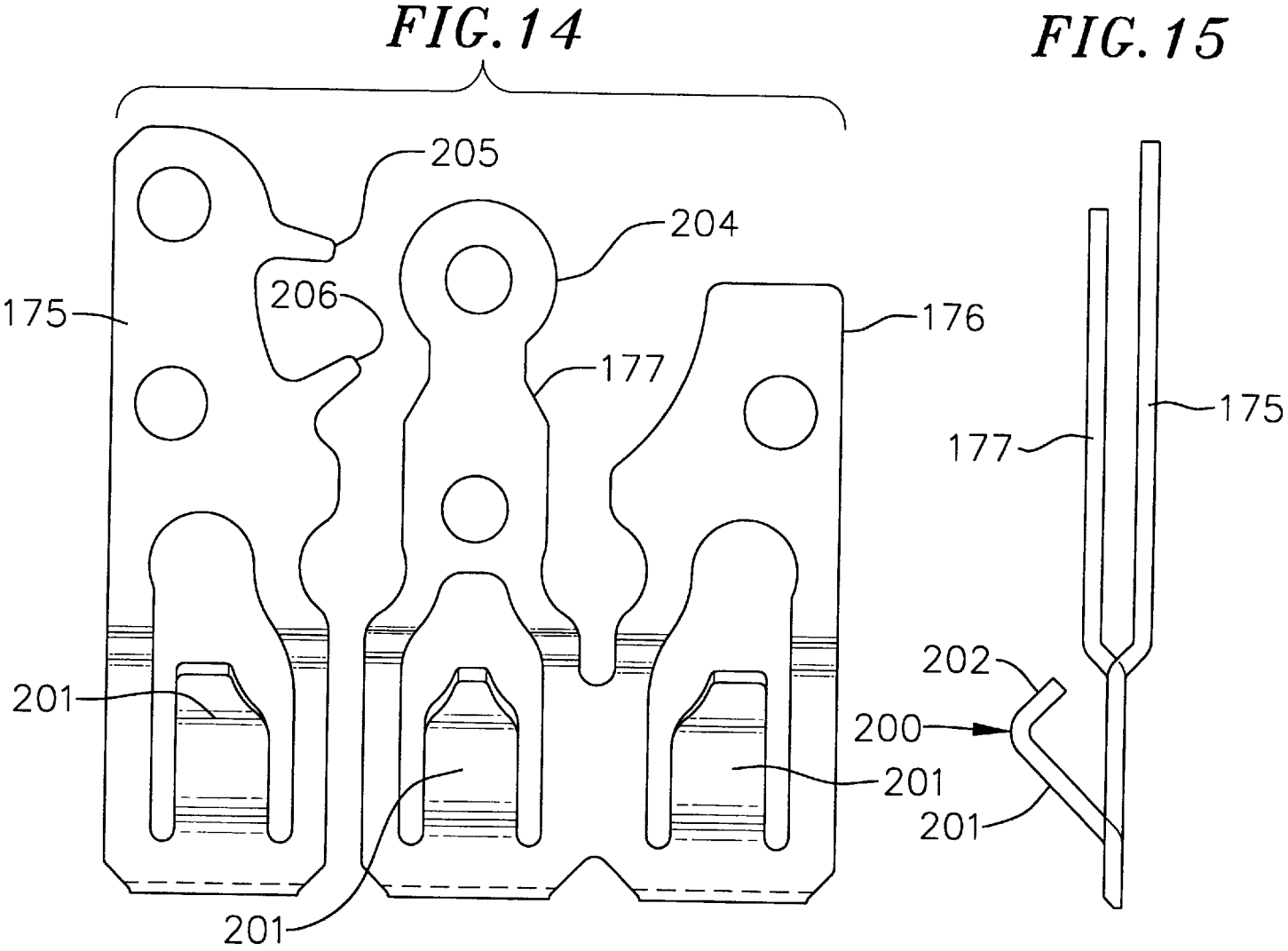
FIG. 14 is a plan view of the electrical contact terminals of the second embodiment of switch.
FIG. 15 is a side view of the electrical contact terminals of the second embodiment of switch.

FIGS. 13 to 15 illustrate the cover and terminal members respectively of another embodiment of pushbutton switch with a slightly different electrical contact arrangement. Most of the switch parts, except as noted below, are essentially the same as in the first embodiment. FIG. 13 illustrates the cover with the electrical contact terminals in place and FIG. 14 illustrates the same terminals in their same positions exploded away from the cover, for clarity. Much of the cover is similar to the cover in the first embodiment, so like parts have been given like reference numerals plus 100. For example, a hole numbered 61 in the first embodiment is identified with the numeral 161 in the second embodiment.

This embodiment of electrical contact terminal comprises a left terminal 175 and a center terminal 177. There is another projection 176 on the right side which is not a separate terminal, but is electrically connected to the center terminal. It is inactive in the present embodiment and has been included solely for providing an external pin arrangement on the switch as desired by a customer. Each of the three "terminal" portions has a U-shaped pierced hole defining a tongue 200. Each tongue is bent down out of the plane of the terminal as a first leg 201 angled relative to the plane of the terminal and a second leg 202 about 90° from the first leg to give the tongue an L-shape as seen in the side view of FIG. 15. When the terminals are mounted on the cover, rectangular electrical lead buses 203 are inserted laterally to engage the L-shaped tongue, bending it upwardly and clamping against the lead for good electrical contact.

The center terminal 177 is bent downwardly and the left terminal 175 is bent upwardly so as to be parallel to and offset from the opposite end of the terminal strips. The center terminal has a generally circular end 204 coaxial with the axis of the barrel when the switch is assembled. A coil spring (not shown) has one end resting on the circular end portion with its opposite end being inside the connector cup (not shown) of the switch. The spring provides electrical contact between the center terminal and the cup. This is used in lieu of the upstanding finger in the first embodiment.

The left terminal has two electrical contact fingers 205, 206 protruding generally radially inwardly toward the axis of the barrel (when the switch is assembled). The two fingers are spaced apart at an angle of 45°. The fingers are sufficiently narrow that a tab on a connector cup will fit between the fingers without making electrical contact with either one. There are three pads 207 adjacent to and between the contact fingers. These pads are raised areas in the cover and have an elevation slightly (about 0.08 mm) below the elevation of the contact fingers. A contact tab on the cup rests on one of the pads or on a contact finger at all times. The pads elevate the cup so that, upon rotation, the contact tabs engage the edge of a finger with a rounded portion of the tab, thereby minimizing wear and degradation of the contact pads and tabs.

Thus, when the plunger of a momentary ON switch with this terminal arrangement is in its normally retracted position, one of the tabs on a connector cup is either between the two fingers, or two tabs (which are 90° apart) are spaced clockwise and counterclockwise, respectively, from the pair of fingers. When the plunger of the switch is depressed the ratchet and cup rotate 22½° when the lugs on the ratchet leave the ways and the teeth on the ratchet and plunger click into full engagement, the tabs advance 22½° and a tab comes into contact with one or the other of the fingers. If a tab was between the fingers, it comes into contact with finger 205. If tabs were spanning the location of the fingers, a tab comes in contact with finger 206. When the plunger is released and retracts, the ratchet engages the ramps on the ends of the splines and rotates an additional 22½°, taking the tab out of contact with the finger. If the tab was originally between the fingers before switch actuation, it now moves to a position beside the finger and another tab moves into a position on the opposite side of the two fingers; and vice versa.

If desired one or more electrical leads may be brought through the cover parallel to the axis of the barrel instead of transverse as illustrated. One can bend one or more of the tongues through a larger angle from the plane of the terminals and turn the L-shape in the opposite direction. The bent tongue can then clamp against an electrical lead extending through the cover.

From this it will also be seen that there are many arrangements of terminal contacts that may be used to make single pole-single throw, single pole-double throw, double pole single-throw, etc., switches.

In view of the foregoing, it will be appreciated that a variety of changes, modifications and variations may be made thereto without departing from the spirit and scope of the invention. Accordingly, the above description should not be used to limit the scope of the invention as defined in the following claims.

What is claimed is:

1. A pushbutton switch comprising:

a body including a barrel with longitudinally extending internal splines and ways between the splines;

a plunger longitudinally movable in the barrel and including radially extending lugs in the ways;

a ratchet coaxial with the plunger, having radially extending dogs which fit into the ways and including a plurality of longitudinally extending camming teeth;

a fixed electrical terminal member;

a rotatable electrical contact member connected to the ratchet for making or breaking contact with the fixed electrical terminal; and a plurality of longitudinally extending camming teeth on the plunger for engagement with camming teeth on the ratchet, the plunger teeth including a leading ramp face and a trailing ramp face wherein the leading ramp face extends a greater distance in the circumferential direction than the trailing ramp face.

2. A pushbutton switch according to claim 1 including a location on the leading ramp face where the apex of a ratchet tooth is stable and wherein the circumferential distance between the beginning of the trailing ramp face and the stable location is equal to the circumferential distance between the stable location and the end of the leading ramp face.

3. A pushbutton switch according to claim 2 wherein the fixed electrical terminal member includes a pair of contact pads spaced apart nx where n is an integer and x is a circumferential angle and wherein the circumferential distance corresponds to an circumferential angle of approximately one half x.

4. A pushbutton switch according to claim 3 wherein the number of plunger teeth is equal to 360°/x.

5. A pushbutton switch according to claim 1 wherein electrical contact between the fixed electrical terminal member and the rotatable electrical contact member is made upon one longitudinal stroke of the plunger and electrical contact is broken upon the opposite longitudinal stroke of the plunger.

6. A pushbutton switch according to claim 1 wherein electrical contact is made substantially simultaneously with a tactile and/or auditory signal from the switch as the plunger advances toward the ratchet.

7. A pushbutton switch according to claim 1 wherein the end of each spline adjacent to the ratchet includes a camming ramp surface for engaging a ratchet tooth and advancing the ratchet to an adjacent way.

8. A pushbutton switch comprising:

a body including a barrel with longitudinally extending internal splines and ways between the splines;

a plunger longitudinally movable in the barrel and including radially extending lugs in the ways;

a ratchet coaxial with the plunger, having radially extending dogs which fit into the ways and including a plurality of longitudinally extending camming teeth;

a fixed electrical terminal member;

a rotatable electrical contact member connected to the ratchet for making or breaking contact with the fixed electrical terminal; and a plurality of longitudinally extending camming teeth on the plunger for engagement with camming teeth on the ratchet, the plunger teeth each having an apex offset from a centerline of the tooth for advancing the ratchet a sufficient distance that electrical contact between the fixed electrical terminal member and the rotatable electrical contact member is made substantially simultaneously with a tactile and/or auditory signal from the switch as the plunger advances toward the ratchet.

9. A pushbutton switch according to claim 8 including a location on a first face of a plunger tooth between the plunger tooth apex and the valley between adjacent plunger teeth where the apex of a ratchet tooth is stable.

10. A pushbutton switch according to claim 9 wherein the circumferential distance between the beginning of the first face and the stable location is equal to the circumferential distance between the stable location and the end of the other face of the plunger tooth.

11. A pushbutton switch according to claim 8 wherein the splines and ratchet dogs are arranged so that upon retraction of the plunger, the ratchet comes to a rotational position with the apex of a ratchet tooth at a location on one face of a plunger tooth between the apex of the plunger tooth and the valley between that plunger tooth and the adjacent plunger tooth.

12. A pushbutton switch according to claim 8 wherein electrical contact between the fixed electrical terminal member and the rotatable electrical contact member is made upon one longitudinal stroke of the plunger and electrical contact is broken upon the opposite longitudinal stroke of the plunger.

13. A pushbutton switch comprising:

a body including a barrel with longitudinally extending internal splines and ways between the splines;

a plunger longitudinally movable in the barrel and including radially extending lugs in the ways;

a ratchet coaxial with the plunger, having radially extending dogs which fit into the ways and including a plurality of longitudinally extending camming teeth;

a fixed electrical terminal member;

a rotatable electrical contact member connected to the ratchet for making or breaking contact with the fixed electrical terminal; and a plurality of longitudinally extending camming teeth on the plunger for engagement with camming teeth on the ratchet, wherein the splines and ratchet dogs are arranged so that upon retraction of the plunger, the ratchet comes to a rotational position with the apex of a ratchet tooth at a location on one face of a plunger tooth between the apex of the plunger tooth and the valley between that plunger tooth and the adjacent plunger tooth.

14. A pushbutton switch according to claim 13 wherein the rotational position is equidistant from the valley at each end of the tooth.

15. A pushbutton switch according to claim 13 wherein electrical contact is made substantially simultaneously with a tactile and/or auditory signal from the switch as the plunger advances toward the ratchet.

16. A pushbutton switch according to claim 13 wherein electrical contact between the fixed electrical terminal member and the rotatable electrical contact member is made upon one longitudinal stroke of the plunger and electrical contact is broken upon the opposite longitudinal stroke of the plunger.

17. A pushbutton switch comprising:

a body including a barrel with longitudinally extending internal splines and ways between the splines;

a plunger longitudinally movable in the barrel and including radially extending lugs in the ways;

a ratchet coaxial with the plunger, having radially extending dogs which fit into the ways and including a plurality of longitudinally extending camming teeth;

a fixed electrical terminal member;

a rotatable electrical contact member connected to the ratchet for making or breaking contact with the fixed electrical terminal; and a plurality of longitudinally extending camming teeth on the plunger for engagement with camming teeth on the ratchet, the plunger teeth each having an apex offset from a centerline of the tooth for advancing the ratchet a sufficient distance that electrical contact between the fixed electrical terminal member and the rotatable electrical contact member is made upon one longitudinal stroke of the plunger and electrical contact is broken upon the opposite longitudinal stroke of the plunger.

18. A pushbutton switch according to claim 17 wherein the splines and ratchet dogs are arranged so that upon retraction of the plunger, the ratchet comes to a rotational position with the apex of a ratchet tooth at a stable location on a first face of a plunger tooth between the apex of the plunger tooth and the valley between the first plunger tooth and the adjacent plunger tooth.

19. A pushbutton switch according to claim 18 wherein the circumferential distance between the beginning of the first face and the stable location is equal to the circumferential distance between the stable location and the end of a second face of the plunger tooth.

20. A pushbutton switch according to claim 17 wherein electrical contact is made substantially simultaneously with a tactile and/or auditory signal from the switch as the plunger advances toward the ratchet.

* * * * *